US005415075A

United States Patent [19]

Moon

[11] Patent Number: 5,415,075

[45] Date of Patent: May 16, 1995

[54] STAGGERED CAMMING MACHANISM FOR A FIREARM

[76] Inventor: Kook-Jin Moon, 630 Route 303, Blauvelt, N.Y. 10913

[21] Appl. No.: 123,063

[22] Filed: Sep. 17, 1993

[51] Int. Cl.[6] ..... F41A 5/04; F41A 5/10

[52] U.S. Cl. ..... 89/163; 89/196

[58] Field of Search ..... 89/163, 196

[56] References Cited

U.S. PATENT DOCUMENTS

| | | | |
|---|---|---|---|
| 1,618,510 | 2/1927 | Browning | 89/163 |
| 2,664,786 | 1/1954 | Guisasola | 89/163 |
| 3,504,594 | 4/1970 | Greeley | 89/163 |
| 3,756,120 | 9/1973 | Roy | 89/163 |
| 4,854,217 | 8/1989 | Ransom | 89/163 |
| 5,309,815 | 5/1994 | Möller | 89/163 |

FOREIGN PATENT DOCUMENTS

| | | | |
|---|---|---|---|
| 424528 | 1/1926 | Germany | 89/163 |

*Primary Examiner*—David Brown

*Attorney, Agent, or Firm*—McCormick, Paulding & Huber

[57] ABSTRACT

A firearm having a moveable breech locking barrel supported on a receiver by an offset barrel cam lug which cooperates with a wall of the receiver to provide space between the lug and the receiver wall to receive therebetween portions of a trigger and an associated trigger bar when the barrel moves to an unlocked position.

11 Claims, 3 Drawing Sheets

STAGGERED CAMMING MACHANISM FOR A FIREARM

FIELD OF THE INVENTION

This invention relates primarily to firearms and more particularly to improvements in a firearm of the type having a breech locking barrel.

BACKGROUND OF THE INVENTION

In a gun having a breech locking barrel which requires, because of its overall design, a trigger bar to be positioned above the pivot pin of the trigger, a problem often occurs in avoiding interference between the trigger bar and the cam of the barrel when compact positioning is an objective of the design. An improved design for the camming lug of the barrel and optimum positioning of the trigger bar with respect to the trigger are areas where improvements can be made.

One area in which compactness of a handgun can be achieved relates to how closely the trigger assembly and the barrel can be positioned relative to each other. When a breech-locking barrel is used and the trigger bar is positioned above the pivot pin of the trigger, the trigger, the trigger bar and the barrel must be arranged so that interference cannot occur between the trigger, the trigger bar and the barrel, because of the movement of the intervening cam element enabling rotation of the barrel between its locked and unlocked positions. Such a handgun usually has a relatively high profile, the barrel being positioned a substantial distance above the trigger guard and handle or pistol grip.

In order to provide compactness generally in a handgun, others have devised various designs. For instance, U.S. Pat. No. 1,618,310 to Browning teaches the use of an annular flange to guide the barrel at its forward end, and the cooperation between a cam groove and a fixed part of the firearm frame to receive the barrel lug, at the rear end. Thus, Browning provides a stepped structure to achieve compactness and efficiency of design, but does not teach a camming mechanism structure similar to the present invention. Likewise, U.S. Pat. Nos. 2,664,786 and 4,854,217 of Guisasola and Ranson, respectively, teach lock mechanisms for the barrel of a gun, but do not teach a similar camming mechanism design, as with the present invention, to achieve compactness and efficiency.

OBJECTS AND SUMMARY OF THE INVENTION

Accordingly, a primary object of the present invention is to provide a compact low profile handgun, particularly in a semi-automatic, breech-locking barrel gun design.

A further and more particular object is to provide an improved barrel cam design for a breech-locking barrel of a handgun, which enables efficient and compact design in a gun where the trigger bar is positioned above the pivot pin of the trigger.

Other objects of the present invention are achieved in a handgun mechanism wherein the barrel is positioned closer to the hand of the user, to reduce the effects of muzzle flip and recoil when the gun is fired.

BRIEF DESCRIPTION OF THE DRAWINGS

Other objects, features and advantages of the present invention will become apparent by the following detailed description of the preferred, but nonetheless illustrative, embodiment, with reference to the accompanying drawings, wherein.

DETAILED DESCRIPTION OF THE PREFERRED EMBODIMENT

Figure 1:
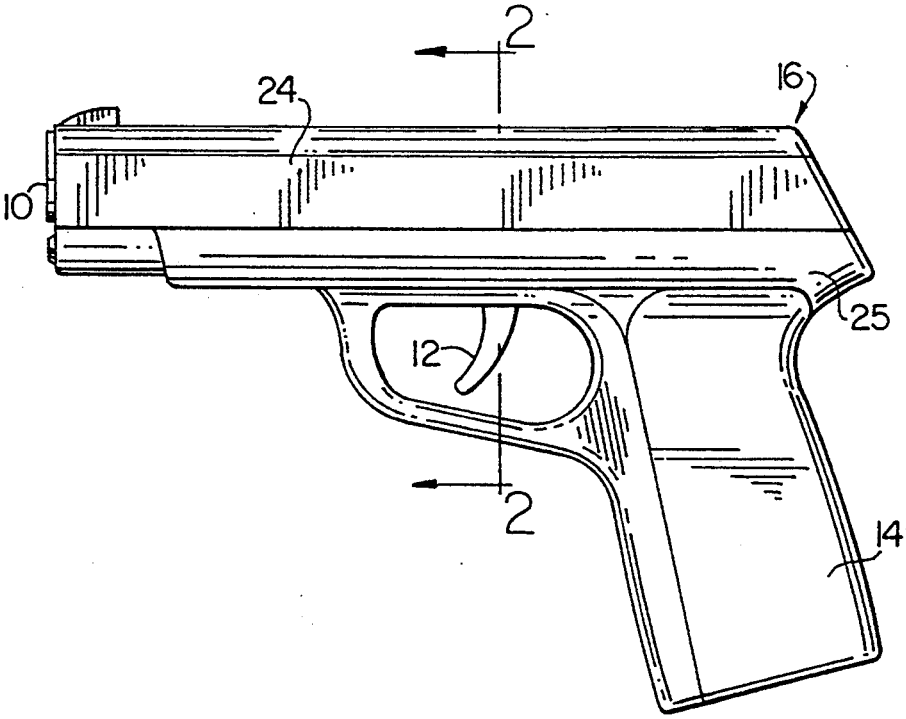
FIG. 1 is a side elevational view of a semi-automatic handgun embodying the present invention.

Referring to the drawings, a semi-automatic handgun embodying the present invention is shown in FIG. 1 and includes a frame or receiver 25, an operating slide 24, a barrel 10, a trigger 12 and a handle or pistol grip 14, the breech end of the handgun being generally designated 16.

Figure 2:
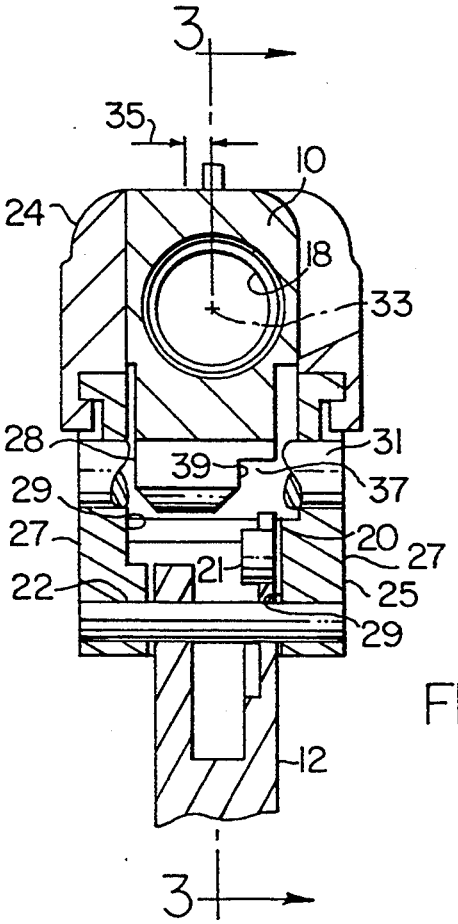
FIG. 2 is a fragmentary sectional view taken generally along the line 2—2 of FIG. 1 and showing particularly the relative positions of the barrel cam and trigger assembly.
Figure 3:
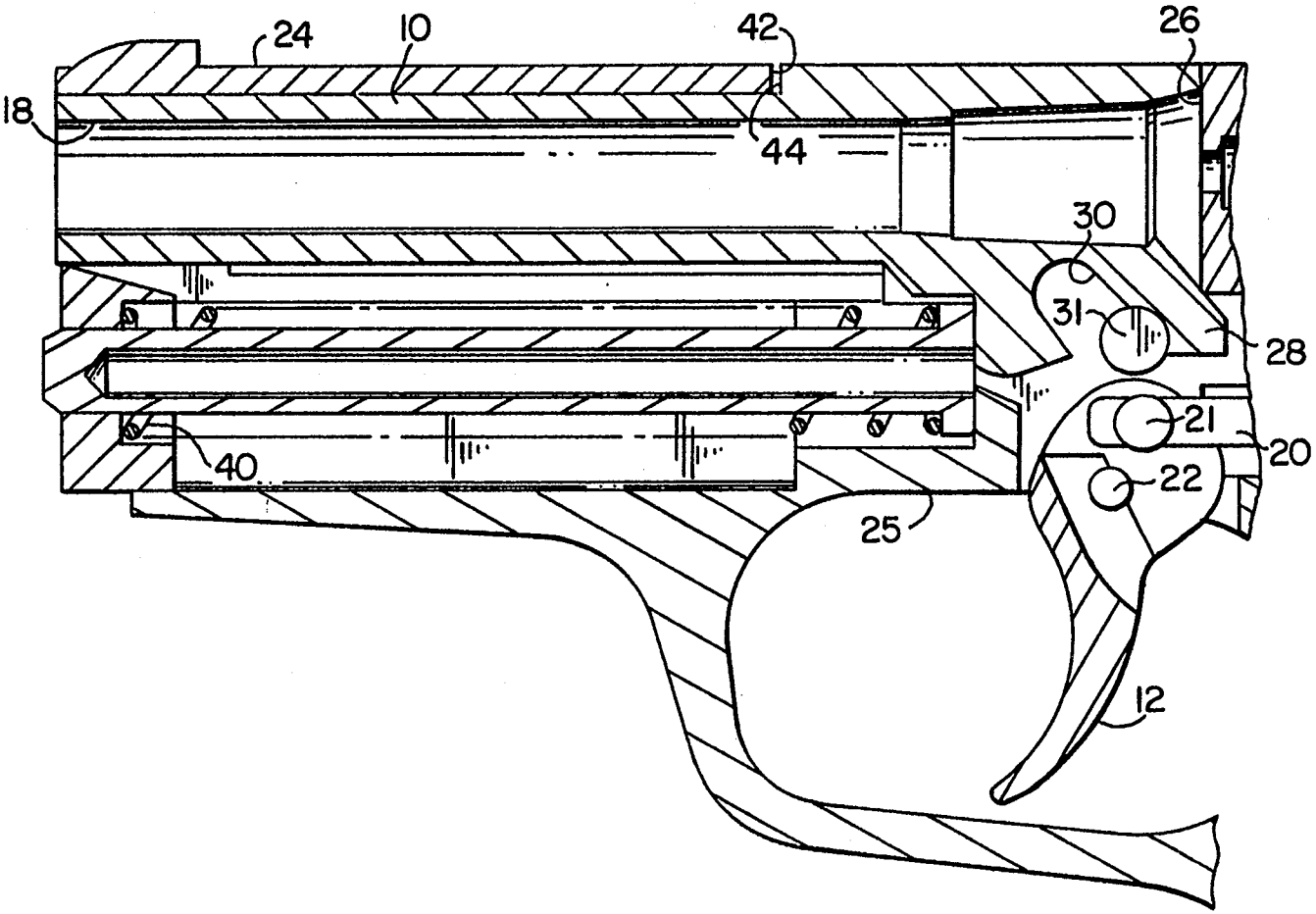
FIG. 3 is a fragmentary sectional view taken along the line 3—3 of FIG. 2 and showing the barrel in its locked position.
Figure 4:
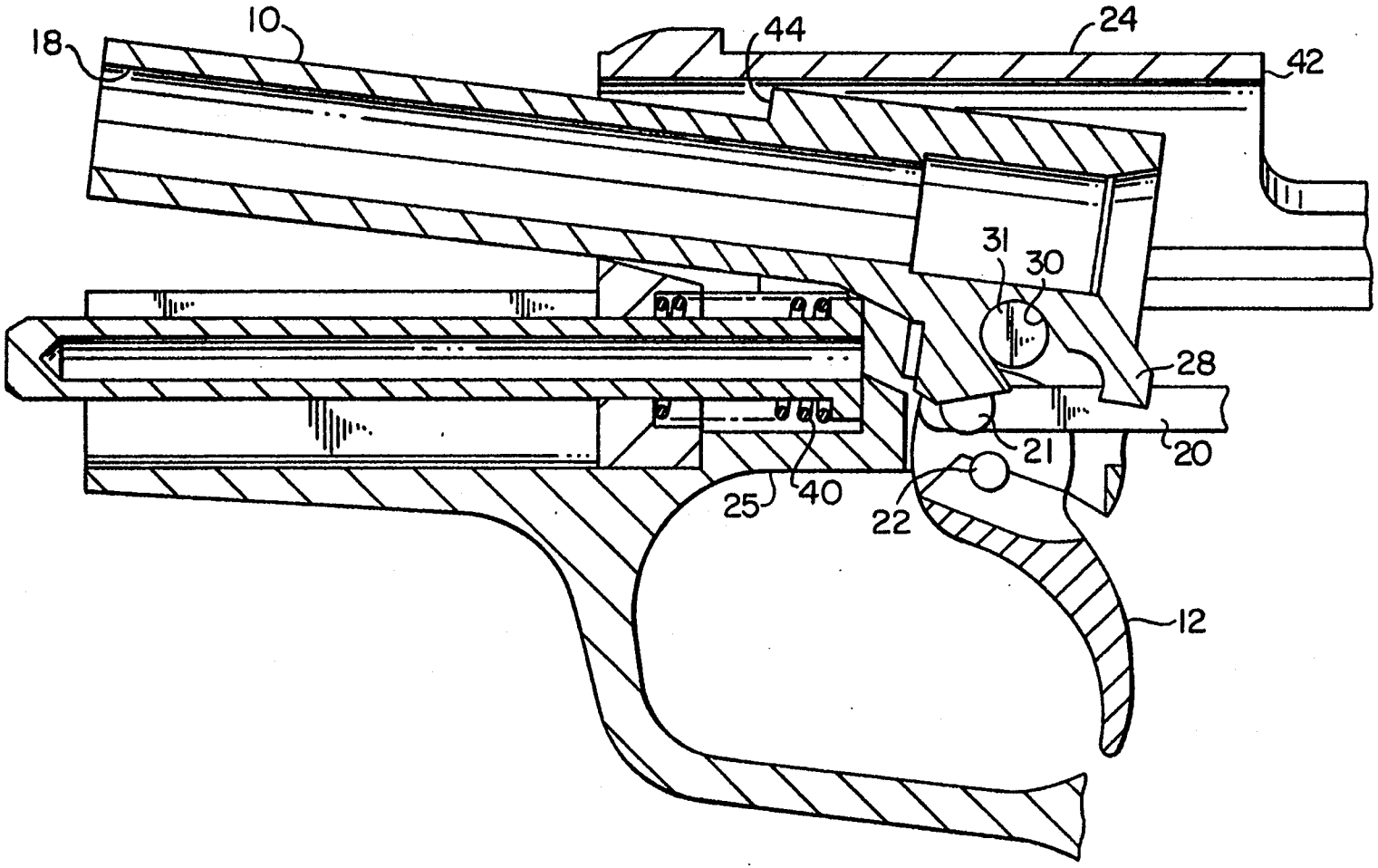
FIG. 4 is a view similar to that of FIG. 3, but showing the barrel in an unlocked position and the slide in a retracted position.

In more detail, FIGS. 2–4 show the barrel structure 10 which includes a cylindrical barrel having a bore 18 extending coaxially through it. The barrel 10 further includes an integral barrel cam lug 28 which defines a cam surface 30. The barrel cam lug 28 projects downwardly from the rear end portion of the barrel and extends into the upwardly Open receiver 25. The receiver is defined by opposing frame sidewalls 27, 27 having laterally spaced apart inner surfaces 29, 29, as best shown in FIG. 2. A barrel mounting or camming pin 31 is supported by the frame sidewalls 27, 27 and extends laterally across the receiver 25 engaging the cam surface 30 to support the barrel 10 for limited forward and rearward movement longitudinally of the receiver 25 and for pivotal movement relative to the receiver. A trigger bar 20 is pivotally connected to the trigger 12 by a trigger bar pivot pin 21. The trigger bar 20 is located at one side of trigger 12 and positioned above a trigger pivot pin 22 (FIG. 3) which defines a pivotal axis of the trigger 12. Thus, the trigger 12 is supported to pivot about an axis extending laterally of the receiver between an inactive position shown in FIG. 3 and a firing position shown in FIG. 4.

The operating slide 24 which provides a shroud for the barrel 10, is supported on the receiver for sliding movement longitudinally of the receiver between a forward position shown in FIG. 3 and a retracted position shown in FIG. 4, and is biased toward its forward position by a spring 40. The forward and retracted positions of the operating slide correspond, respectively, to the locked and unlocked positions of the barrel 10 also shown, respectively, in FIGS. 3 and 4. A rearwardly facing abutment surface 42 on the operating slide cooperates with a forwardly facing surface 44 on the barrel to releasably retain the barrel in its locked position against the breech face 26 (FIG. 3) when the slide is in its forward position.

In order to provide a more compact weapon wherein the barrel 10 is positioned more closely to the hand of the user in order to reduce what is commonly referred to in the industry as "muzzle flip" and recoil effects, the barrel cam lug 28 is staggered or laterally offset relative to the axis of the barrel bore 18 as shown in FIG. 2. In FIG. 2 the central axis of the barrel cam lug 28 is indicated at 33. The lateral offset of the barrel cam lug 28 relative to the axis of the bore 18 is indicated at 35. In this manner of construction, and as shown, the trigger 12, trigger bar 20 and barrel 10 may be positioned more closely to each other to produce a compact gun. The lateral offset of the barrel cam lug 28 provides a space or notch 37 between an associated one of the inner surfaces 29 and an opposing face 39 on the barrel cam lug 28. When the barrel 10 is in its unlocked position, as it appears in FIG. 4, associated portions of the trigger 12 and the trigger bar 20 are located in the space 37.

It will be noted that the barrel cam lug 28 is located at the rear end portion of the barrel 10 and that the trigger pivot pin 22 is located generally vertically below and in parallel alignment with the barrel pivot pin 30. A portion of the trigger bar 20 is disposed between the barrel camming pin 31 and the trigger pivot pin 22 and moves therebetween in response to movement of the trigger between its inactive position of FIG. 3 and its firing position of FIG. 4. This close structural arrangement of parts relative to each other coupled with the lateral offset of the barrel cam lug 28 enables construction of a compact breech locking handgun having an unusually low profile.

Although the invention has been described in the foregoing in sufficient detail to enable one to reproduce the structure, such description is not intended to limit the present invention, which is to be extended only to the limits of the following claims:

What is claimed is:

1. A firearm having an elongate upward open receiver including opposing laterally spaced apart sidewalls, a breech locking barrel having a bore extending axially therethrough and including a muzzle end and a breech end, said barrel having a depending cam lug spaced in an axial direction from said muzzle end and extending downwardly within said receiver and between said sidewalls, said cam lug being laterally offset relative to the axis of said bore and defining a cam surface, a barrel camming pin mounted on said receiver and having a laterally extending camming pin axis, said camming pin engaging said cam surface to support said barrel for forward and rearward movement longitudinally of said receiver and for pivotal movement relative to said receiver between locked and unlocked positions, an operating slide for moving said barrel between said locked and unlocked positions and for releasably securing said barrel in said locked position, and a firing mechanism including an operating trigger mounted in said receiver below said barrel camming pin and disposed below said cam lug when said barrel is in its locked position, a portion of said trigger being disposed generally adjacent said laterally offset cam lug and between said cam lug and an associated one of said sidewalls when said barrel is in its unlocked position.

2. A firearm as set forth in claim 1 wherein said cam lug depends from said breech end of said barrel.

3. A firearm as set forth in claim 1 wherein said firing mechanism includes a trigger bar operably connected to said trigger and disposed below said cam lug when said barrel is in its locked position, a portion of said trigger bar being disposed between said cam lug and said associated one of said sidewalls when said barrel is in its unlocked position.

4. A firearm as set forth in claim 3 wherein said trigger is mounted on a trigger pivot pin for pivotal movement about a trigger axis disposed below and in generally parallel alignment with the axis of said camming pin.

5. A firearm as set forth in claim 4 wherein said trigger pin is disposed below and in general vertical alignment with said camming pin.

6. A firearm as set forth in claim 4 wherein said trigger bar is supported for movement between said barrel camming pin and said trigger pivot pin in response to operative movement of said trigger.

7. A firearm as set forth in claim 4 wherein said trigger bar is connected to said trigger for pivotal movement about a trigger bar axis relative to said trigger.

8. A firearm as set forth in claim 7 wherein said trigger bar axis is located below said camming pin axis and above said trigger axis.

9. In a firearm having a frame defining an upwardly open receiver including opposing sidewalls, an operating slide supported on the frame for reciprocal forward and rearward movement between a forward position and a retracted position, a breech locking barrel having an axially extending bore and including front and rear ends and a depending cam lug defining a cam surface, a barrel camming pin supported in fixed position by said sidewalls and extending laterally across said receiver, said barrel camming pin having a barrel camming pin axis and engaging said cam surface and supporting said barrel on said receiver for limited forward and rearward movement and pivotal movement about said barrel pivot axis and relative to said receiver between locked and unlocked positions corresponding respectively to the forward and retracted positions of the operating slide, said operating slide in its forward position cooperating with the barrel to retain the barrel in its locked position, a trigger, a trigger pivot pin mounted in fixed position on said sidewalls and extending laterally across said receiver, said trigger pivot pin supporting said trigger for pivotal movement about a trigger axis and relative to said frame between inactive and firing positions, and a trigger bar connected to said trigger for pivotal movement about a trigger bar axis relative to said trigger and extending rearwardly from the trigger, the improvement wherein said trigger pivot pin is disposed generally vertically below and in axially parallel alignment with said camming pin, said camming lug depends from the rear end portion of said barrel and has a central axis parallel to and laterally offset relative to the axis of said bore and cooperates with one of said sidewalls to define a space between said one of said sidewalls and an associated opposing face of said camming lug, said camming lug is disposed above said trigger bar and said trigger when said barrel is in its locked position, and portions of said trigger and said trigger bar are received within said space when said barrel is in its unlocked position.

10. In a firearm as set forth in claim 9 the further improvement wherein said trigger bar axis is located above said trigger axis and below said barrel camming pin.

11. A firearm as set forth in claim 10 the further improvement wherein said trigger bar is moveable between said trigger pivot pin and said barrel camming pin in response to the movement of said trigger.

* * * * *